US008371881B2

(12) United States Patent
Zhou

(10) Patent No.: US 8,371,881 B2
(45) Date of Patent: Feb. 12, 2013

(54) ELECTRIC SOCKET

(75) Inventor: Jianlin Zhou, Dongguan (CN)

(73) Assignee: Mig Electronic Industrial Co., Ltd., Dongguan (CN)

( * ) Notice: Subject to any disclaimer, the term of this patent is extended or adjusted under 35 U.S.C. 154(b) by 0 days.

(21) Appl. No.: 13/158,473

(22) Filed: Jun. 13, 2011

(65) Prior Publication Data

US 2012/0220165 A1 Aug. 30, 2012

(51) Int. Cl.
*H01R 25/00* (2006.01)

(52) U.S. Cl. ..... 439/652; 439/272

(58) Field of Classification Search ..... 439/653, 439/272, 241, 682, 685, 680, 526, 686, 536; 174/66

See application file for complete search history.

(56) References Cited

U.S. PATENT DOCUMENTS 2,239,653 A * 4/1941 O'Brien ..... 439/137
2,619,515 A * 11/1952 Doane ..... 439/274
3,096,132 A * 7/1963 Hubbell ..... 439/137
3,571,779 A * 3/1971 Collier ..... 439/587
3,643,207 A * 2/1972 Cairns ..... 439/201
4,293,173 A * 10/1981 Tricca ..... 439/148
4,299,434 A * 11/1981 Ishikawa ..... 439/394
4,527,852 A * 7/1985 Dechelette ..... 439/408
4,690,478 A * 9/1987 Rahrig et al. ..... 439/271
4,796,159 A * 1/1989 Miksche ..... 361/832
5,017,153 A * 5/1991 Bowman ..... 439/426
5,596,486 A * 1/1997 Young et al. ..... 361/737
7,071,414 B2 * 7/2006 Kim ..... 174/66

* cited by examiner

*Primary Examiner* — Phuong Dinh

(57) ABSTRACT

An electric socket includes a socket housing defining prong slots therein. Conductive terminals are disposed in the socket housing. An electrically and thermally insulating protective plate is disposed in the socket housing. The protective plate is disposed between the conductive terminals and the side of the socket housing that forms the prong slots. The protective plate includes a substrate and ring protrusions extending into the prong slots and each having an outer profile matching an inner profile of a corresponding prong slot. A central portion of each ring protrusion defines a through hole aligning with a corresponding prong slot. By providing the electrically and thermally insulating protective plate between the conductive terminals and the socket housing, the electric socket can prevent the high temperature and sparks produced at the conductive terminals from igniting the socket housing to cause fire, thus having improved product reliability.

5 Claims, 3 Drawing Sheets

ELECTRIC SOCKET

BACKGROUND OF THE INVENTION

1. Field of the Invention

The present invention relates to electric sockets and, more particularly, to an electric socket with high reliability.

2. Description of Related Art

Existing electric sockets have a socket housing that is typically made of a plastic material with good electrically insulating capability. The socket housing has prong slots for insertion of a plug of an electric appliance. In use, high temperature or sparks may be produced at a contact area between the plug of the electric appliance and conductive terminals in the housing, which can easily ignite the plastic material of the socket housing thus causing fire. Therefore, some existing sockets have a poor reliability.

SUMMARY OF THE INVENTION

Accordingly, the present invention is directed to an electric socket which can prevent the high temperature and sparks produced at the conductive terminals from igniting the socket housing to cause fire, thus having improved product reliability.

In one embodiment, an electric socket is provided. The electric socket includes a socket housing defining prong slots in one side thereof. A plurality of conductive terminals is disposed in the socket housing. A protective plate that is electrically and thermally insulating is disposed in the socket housing. The protective plate is disposed between the conductive terminals and the side of the socket housing that forms the prong slots. The protective plate may include a substrate and a plurality of ring protrusions extending into the prong slots and each having an outer profile matching an inner profile of a corresponding one of the prong slots. A central portion of each ring protrusion defines a through hole aligning with a corresponding one of the prong slots.

In one embodiment, the protective plate is a ceramic member.

In one embodiment, the prong slots include at least two groups of prong slots, and one individual protective plate is disposed in correspondence with each group of prong slots.

In one embodiment, the socket housing includes a front housing part and an end cover, the prong slots are formed in a top side of the front housing part, a bottom side of the front housing part defines an opening, and the end cover is fixedly mounted to the bottom side of the front housing part to form an inner chamber for receiving the conductive terminals and the protective plate.

In one embodiment, the socket housing includes a switch disposed thereon, the switch electrically connected with the conductive terminals.

In embodiments of the electric socket, the electrically and thermally insulating protective plate is provided between the conductive terminals and the socket housing, which can prevent the high temperature and sparks produced at the conductive terminals from igniting the socket housing to cause fire, thus improving the product reliability.

DESCRIPTION OF THE EMBODIMENTS

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
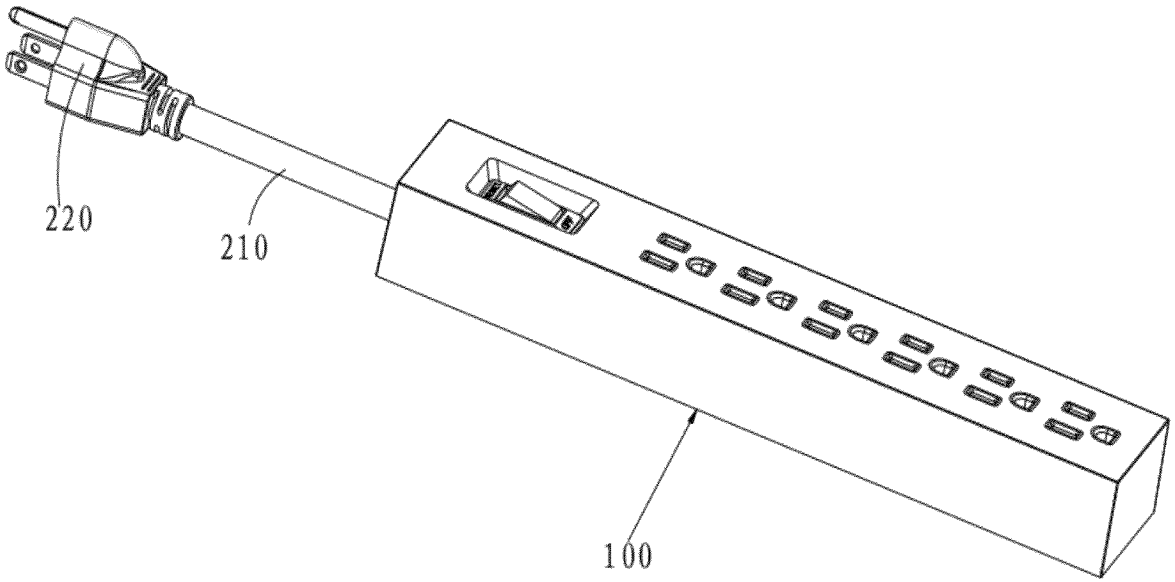
FIG. 1 is an assembled perspective view of an electric socket.
Figure 2:
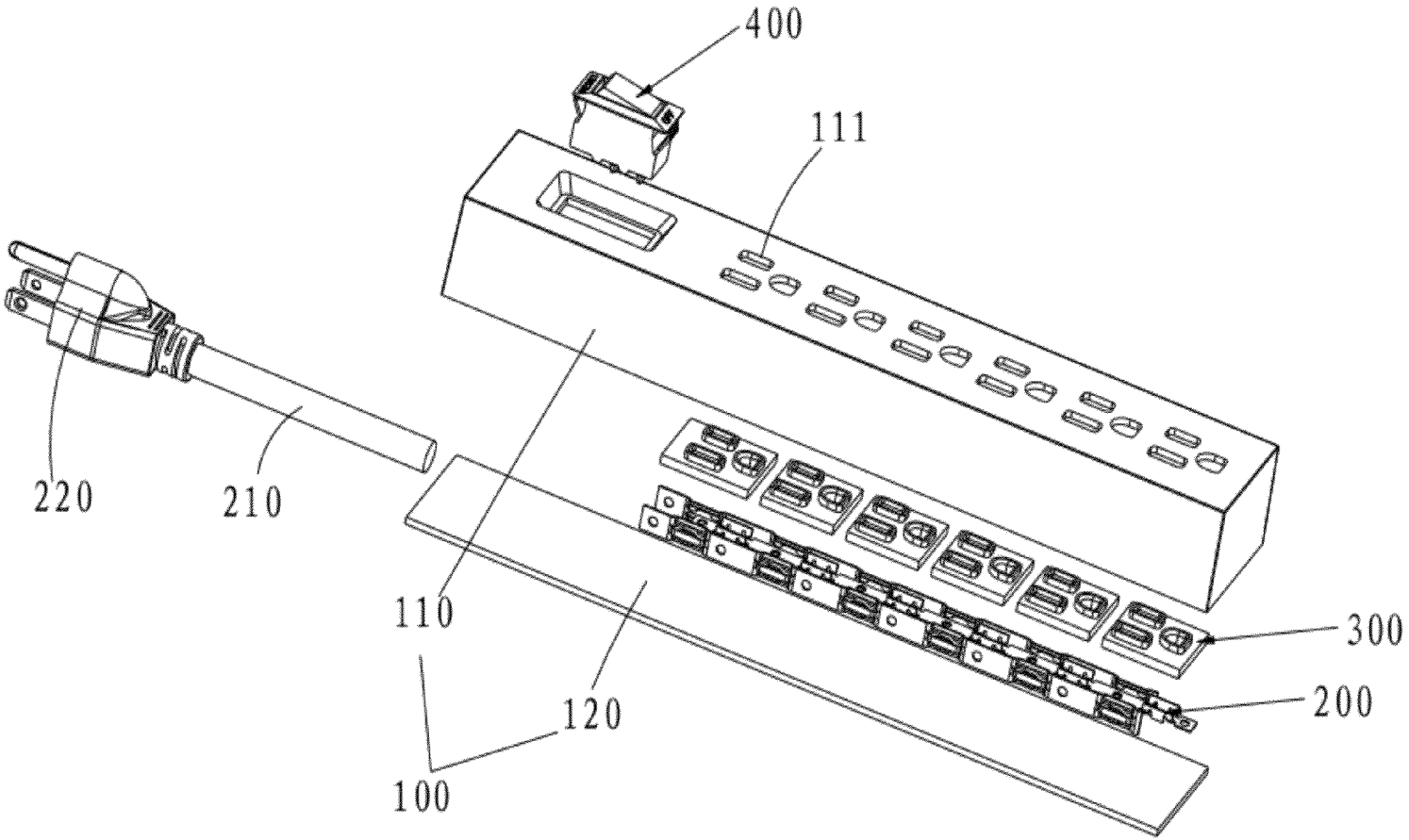
FIG. 2 is an exploded perspective view of the electric socket.

As shown in FIG. 1 and FIG. 2, an electric socket is illustrated, which includes a socket housing 100 with conductive terminals 200 disposed therein. The conductive terminals 200 are connected with an extension wire 210 which in turn connects to a plug 220. One side of the socket housing 100 is formed with prong slots 111 for insertion of prongs of a plug of an electric appliance. Electrically and thermally insulating protective plates 300 are disposed within the socket housing 100. The protective plates 300 are disposed between the conductive terminals 200 and the side of the socket housing 100 that forms the prong slots 111. The protective plate 300 defines through holes 303 positioned in correspondence with the prong slots 111. With this design, even in the case of a short circuit or overload of the electric appliance, the sparks produced at the contact areas between the electric appliance's plug and the conductive terminals 200 will not ignite the socket housing 100, thus preventing the socket housing 100 from catching fire. This eliminates any potential accident and improves the reliability of the electric socket.

Figure 3:
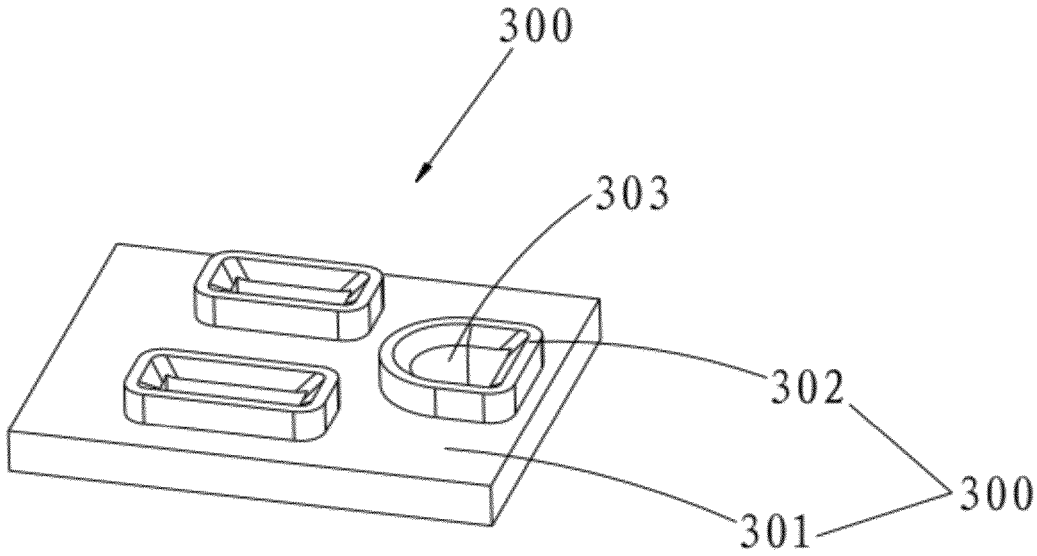
FIG. 3 is a perspective view of a protective plate of the electric socket.

FIG. 2 and FIG. 3 illustrate one exemplary embodiment of the protective plate 300. Specifically, the protective plate 300 includes a substrate 301 and a plurality of ring protrusions 302 extending from the substrate 301. Each of the ring protrusions 302 extends into a corresponding one of the prong slots 111 and has an outer profile matching an inner profile of the corresponding prong slot 111. In the illustrated embodiment, the ring protrusions 302 are flush with a top surface of the socket housing 100. In another embodiment, however, these ring protrusions 302 may also be slightly higher or slightly lower than the top surface of the socket housing 100, without departing from the spirit and scope of the present invention. Each through hole 303 is defined at a central portion of a corresponding ring protrusion 302. With this arrangement, the protective plate 300 can be reliably positioned with respect to the prong slots 111 and prevented from sliding freely, thus resulting in a reliable structure. In addition, the provision of the ring protrusions 302 reinforces the protective plate 300, which guarantees that the product can pass the impact test during safety test and hence improves the reliability of the product. The substrate 301 may be in the form of a planar plate, a recessed plate, or of another shape, to protect sidewalls of the socket housing 100 from being ignited by sparks.

In one exemplary embodiment, the protective plate 300 may be a ceramic member, which is not only electrically insulating, but also heat-resistant and thermally insulating, thus advantageously ensuring the product safety and reliability.

In the exemplary embodiment shown in FIG. 1 and FIG. 2, there are at least two groups of prong slots 111, with each group containing three prong slots 111 for insertion of one plug. A protective plate 300 is provided for each group of prong slots 111. With this design, an individual protective plate 300 is disposed at a position corresponding to each group of prong slots 111, thus resulting in a reliable structure. This design can also increase the universality of the protective plates 300 during use. Different electric sockets may have a different number of the groups of prong slots 111 that are arranged in a different pattern. With each protective plate 300 corresponding to a respective group of prong slots 111 which are of a standard size, even in the case of an electric socket having a different size, an appropriate number of protective plates 300 can be mounted within the socket housing 100, corresponding to respective groups of prong slots 111, without the need of multiple sets of moulds for fabricating the protective plates. This brings convenience to product fabrication and warehouse management, facilitates reducing the fabrication cost, as well as increases the product competitiveness. While the protective plates 300 are illustrated as being separate plates, it is noted that, in various alternative embodiments, the protective plates 300 may be integrated into a unitary structure without departing from the spirit and scope of the present invention.

Referring to FIG. 1 and FIG. 2, in this exemplary embodiment, the socket housing 100 includes a front housing part 110 and an end cover 120. The prong slots 111 are defined in a top side of the front housing part 110, and a bottom side of the front housing part 110 defines an opening. The end cover 120 is fixedly attached to the bottom side of the front housing part 110 to thereby form an inner chamber for receiving the conductive terminals 200 and the protective plates 300. The end cover 120 can be easily fixed to the front housing part 110 with adhesive or fasteners such as screws.

As shown in FIG. 1 and FIG. 2, in this exemplary embodiment, the socket housing 100 also includes a switch 400 that is electrically connected with the conductive terminals 200. As such, when desired, users can easily switch off or on the power of the conductive terminals 200.

In one exemplary embodiment, a protective plate 300 or protective plates 300 made of a ceramic material can be disposed between the conductive terminals 200 and the end cover 120, for protecting the end cover 120 from being ignited by sparks produced at the conductive terminals 200. This improves the reliability of the product.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An electric socket comprising:

a socket housing defining prong slots in one side thereof;

a plurality of conductive terminals disposed in the socket housing;

a protective plate that is electrically and thermally insulating, the protective plate disposed between the conductive terminals and the side of the socket housing that forms the prong slots, the protective plate comprising:

a substrate; and a plurality of ring protrusions extending into the prong slots and each having an outer profile matching an inner profile of a corresponding one of the prong slots, a central portion of each ring protrusion defining a through hole aligning with a corresponding one of the prong slots.

2. The electric socket according to claim 1, wherein the protective plate is a ceramic member.

3. The electric socket according to claim 1, wherein the prong slots include at least two groups of prong slots, and one individual protective plate is disposed in correspondence with each group of prong slots.

4. The electric socket according to claim 1, wherein the socket housing includes a front housing part and an end cover, the prong slots are formed in a top side of the front housing part, a bottom side of the front housing part defines an opening, and the end cover is fixedly mounted to the bottom side of the front housing part to form an inner chamber for receiving the conductive terminals and the protective plate.

5. The electric socket according to claim 1, wherein the socket housing includes a switch disposed thereon, the switch electrically connected with the conductive terminals.

* * * * *